US005272456A

United States Patent [19]

Ishida

[11] Patent Number: 5,272,456

[45] Date of Patent: Dec. 21, 1993

[54] HIGH-FREQUENCY BIAS SUPPLY CIRCUIT

[75] Inventor: Masatoshi Ishida, Tokyo, Japan

[73] Assignee: NEC Corporation, Tokyo, Japan

[21] Appl. No.: 907,376

[22] Filed: Jul. 1, 1992

[30] Foreign Application Priority Data

Jul. 5, 1991 [JP] Japan ..... 3-164851

[51] Int. Cl.[5] ..... H01P 1/00

[52] U.S. Cl. ..... 333/246; 330/277; 330/286; 330/296

[58] Field of Search ..... 333/245, 246; 330/277, 330/286, 296

[56] References Cited

U.S. PATENT DOCUMENTS 4,658,220 4/1987 Heston et al. ..... 330/286 X

FOREIGN PATENT DOCUMENTS 256202 12/1985 Japan ..... 330/286

*Primary Examiner*—Paul Gensler

[57] ABSTRACT

A high-frequency bias supply circuit includes a plurality of bias supply lines each of which is connected in parallel with others between a corresponding one of selected points along the main signal line and a common bias supply terminal. Each of the bias supply lines has a length and a distance from an adjacent bias supply line different from those of others, the length and the distance being in a range of a $\frac{1}{3}$ to $\frac{3}{8}$ wavelength of the center frequency.

5 Claims, 5 Drawing Sheets

10 TRANSISTOR AMPLIFIER

22 SELF-BIAS CIRCUIT

HIGH-FREQUENCY BIAS SUPPLY CIRCUIT

FIELD OF THE INVENTION

This invention relates to a high-frequency bias supply circuit, and more particularly to, a high-frequency bias supply circuit used for a transmitter, etc. in a satellite communication system, a telephone communication system, etc.

BACKGROUND OF THE INVENTION

Recently, a high-frequency bias supply circuit having a plurality of quarter-wave lines has been used for a transmitter, etc. in a radio communication system, such as a satellite communication system, a telephone communication system, etc. in order to increase a level of current without affecting a RF (radio frequency) signal to be transmitted.

According to a conventional high-frequency bias supply circuit, however, there is a disadvantage in that available frequency bandwidth is not expanded sufficiently, because a ripple occurs in a signal-loss characteristic in the frequency bandwidth.

SUMMARY OF THE INVENTION

Accordingly, it is an object of the invention to provide a high-frequency bias supply circuit in which a signal-pass characteristic of a wide bandwidth having less ripple is obtained.

According to the invention, a high-frequency bias supply circuit, includes:

a main signal line through which a radio frequency signal of a predetermined center frequency is passed; and a plurality of bias supply lines each of which is connected in parallel with others between a corresponding one of selected points along the main signal line and a common bias supply terminal to which a bias current is supplied;

wherein each of the bias supply lines has a length and a distance from an adjacent bias supply line different from those of others, the length and the distance being in a range of a $\frac{1}{3}$ to $\frac{3}{8}$ wavelength of the center frequency.

BRIEF DESCRIPTION OF THE DRAWINGS

The other objects and features of this invention will become understood from the following description with reference to the accompanying drawings; wherein.

DESCRIPTION OF THE PREFERRED EMBODIMENTS

For better understanding the background of the present invention, the basic principle of the conventional technology is first described hereinafter with reference to FIGS. 1 to 6.

Figure 1:
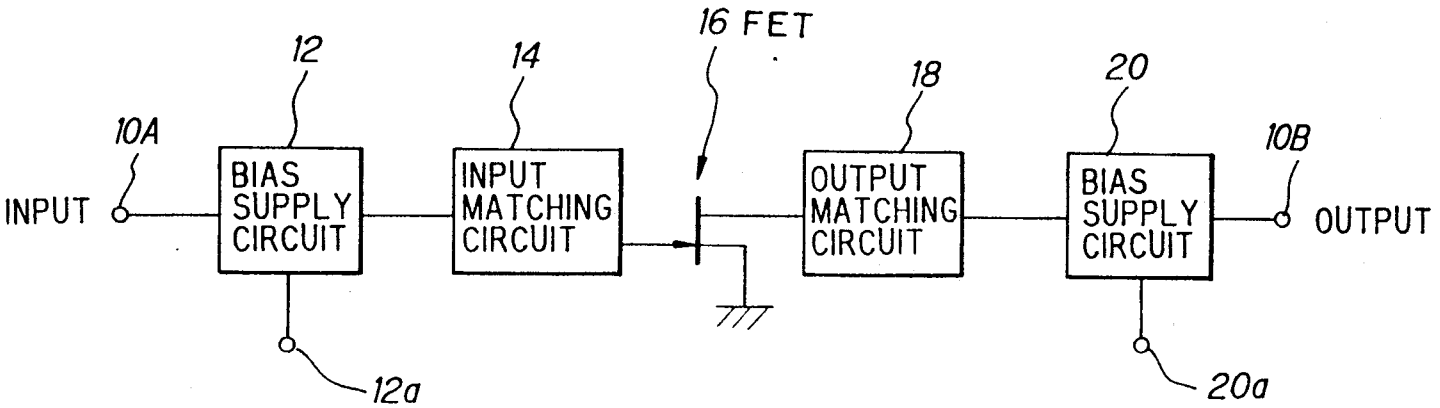
FIG. 1 PRIOR ART
FIG. 1 is a block diagram showing an amplifier used in a RF transmitter including bias supply circuits.

FIG. 1 shows a conventional transistor amplifier 10 which includes a bias supply circuit 12 connected to an input terminal 10A, an input matching circuit 14 connected between the bias supply circuit 12 and a gate of a FET 16 which is connected at a source to ground, an output matching circuit 18 connected to a drain of the FET 16, and a bias supply circuit 20 connected between the output matching circuit and an output terminal 10B.

In operation, when a predetermined bias current is supplied to a bias terminal **12*a* of the bias supply circuits 12, a RF input signal supplied from, for instance, a modulator (not shown) thereto is biased in current. And, a current biased signal is supplied through the input matching circuit 14 to the gate of the FET 16, so that an amplified RF signal is obtained at the drain thereof. Then, the amplified RF signal is supplied through the output matching circuit 18 to the bias supply circuit 20, from which a RF signal to be biased by a predetermined bias current supplied to the bias supply terminal 20*a* is supplied to an output terminal 10B** which is connected, for instance, to a transmitting antenna.

Figure 2:
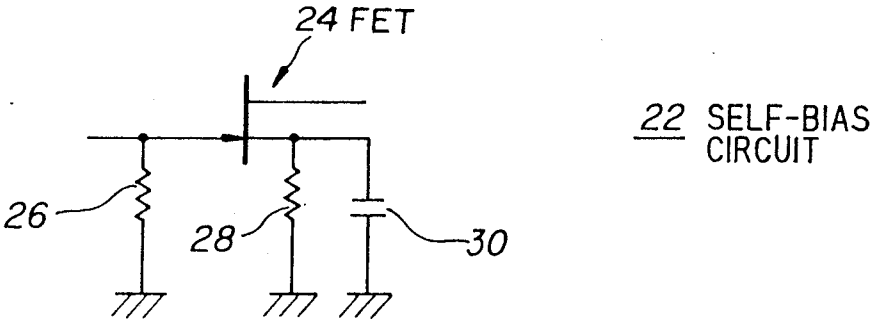
FIG. 2 PRIOR ART
FIG. 2 is a circuit diagram showing a self-bias circuit used in the amplifier of FIG. 1.

In the amplifier 10, a self-bias circuit 22 shown in FIG. 2 may be used therein in stead of the bias supply circuit 12. The self-bias circuit 22 is composed of a FET 24, a resistor 26 having a large resistance connected between a gate of the FET 24 and ground, a resistor 28 having a small resistance connected between a source of the FET 24 and ground, and a capacitor 30 connected between the source of the FET 24 and ground. Further, the high-frequency bias supply circuit may be used for an amplifier of a bipolar transistor (not shown), and for a two electrode device such as a diode, respectively, in place of the FET 16.

Figure 3:
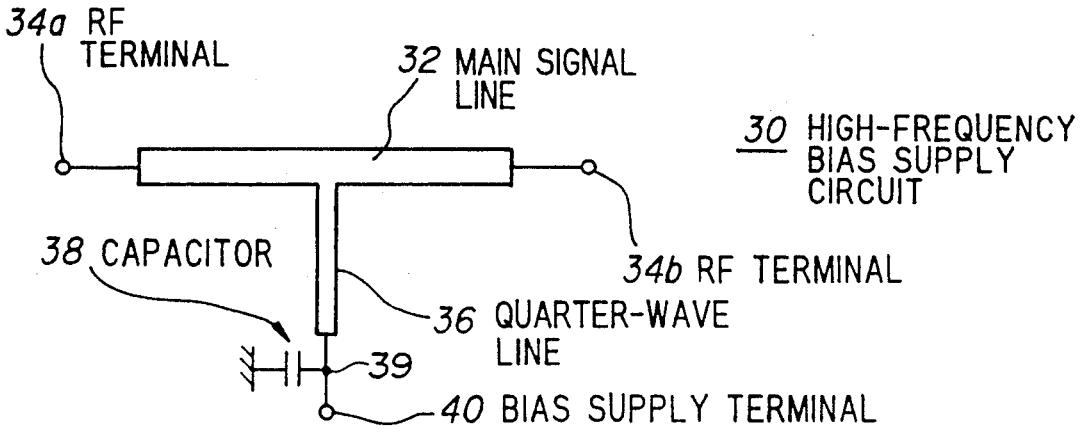
FIG. 3 PRIOR ART
FIG. 3 is a circuit diagram showing a first conventional high-frequency bias supply circuit.

FIG. 3 shows a first conventional high-frequency bias supply circuit 30 which includes a main signal line 32 connected between RF (radio frequency) terminals **34*a* and 34*b*, a quarter-wave line 36 connected at one end to the main signal line 32 and at another end to a bias supply terminal 40, and a capacitor 38 connected between ground and a connection point 39**.

In the high-frequency bias supply circuit 30, when a predetermined bias current is supplied to the bias supply terminal 40, the FET 16 is biased in current with no effect on a radio signal passing through the main signal line 32, because the quarter-wave line 36 functions as an open circuit for the RF signal.

Figure 4:
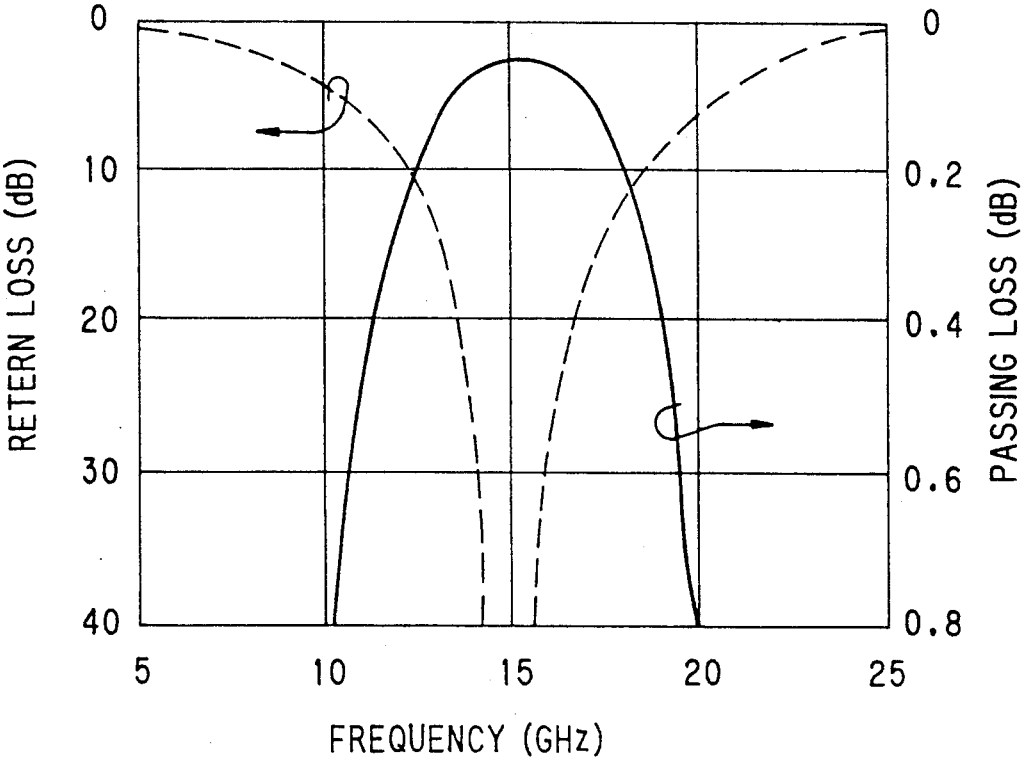
FIG. 4 PRIOR ART
FIG. 4 is a graph showing a signal-pass characteristics of the first conventional high-frequency bias supply circuit.

FIG. 4 shows a radio frequency characteristic of the first conventional high-frequency bias supply circuit 30, wherein a radio signal passing through the main signal line 34 has a center frequency of 15 GHz. In this graph, passing loss of a radio signal is shown by a solid line, and return loss is shown by a dashed line. According to the graph, it is found that the frequency characteristic of the first conventional high-frequency bias supply circuit 30 becomes a curve of secondary degree having a peak at 15 GHz.

Figure 5:
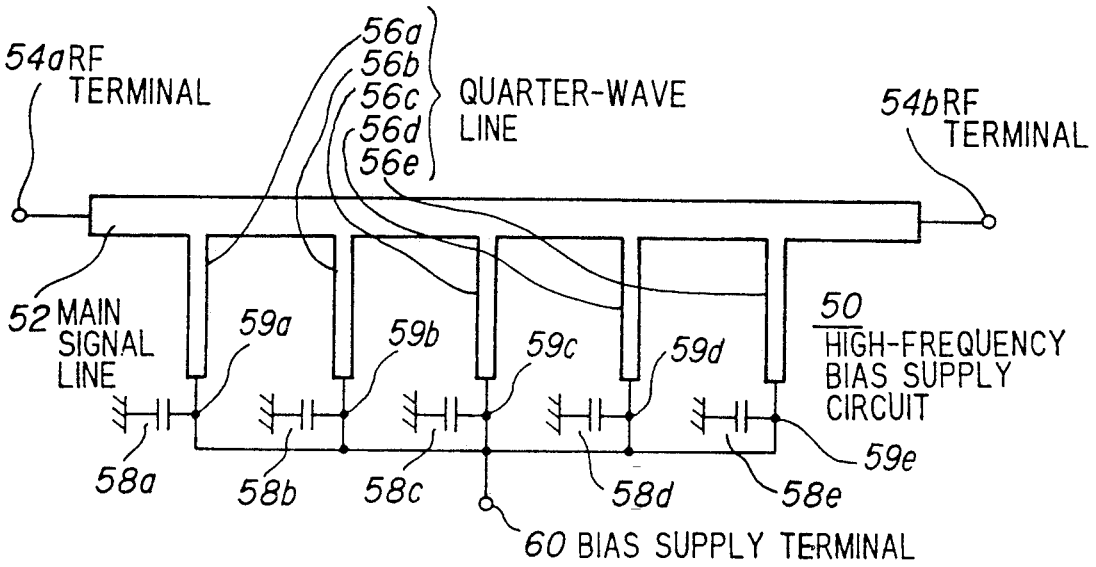
FIG. 5 PRIOR ART
FIG. 5 is a circuit diagram showing a second conventional high-frequency bias supply circuit.

FIG. 5 shows a second conventional high-frequency bias supply circuit 50 which includes a main signal line 52 connected between RF (radio frequency) terminals 54*a* and 54*b*, five of quarter-wave lines 56*a*, 56*b*, 56*c*, 56*d* and 56*e* each connected between one side of the main signal line 52 and a bias supply terminal 60 in common, and five of capacitors 58*a*, 58*b*, 58*c*, 58*d* and 58*e* connected between ground and connection points 59*a*, 59*b*, 59*c*, 59*d* and 59*e*, respectively. Each of the quarter-wave lines 56*a*, 56*b*, 56*c*, 56*d* and 56*e* has a predetermined length to provide a quarter wave of a radio signal passing through the main signal line 54.

Figure 6:
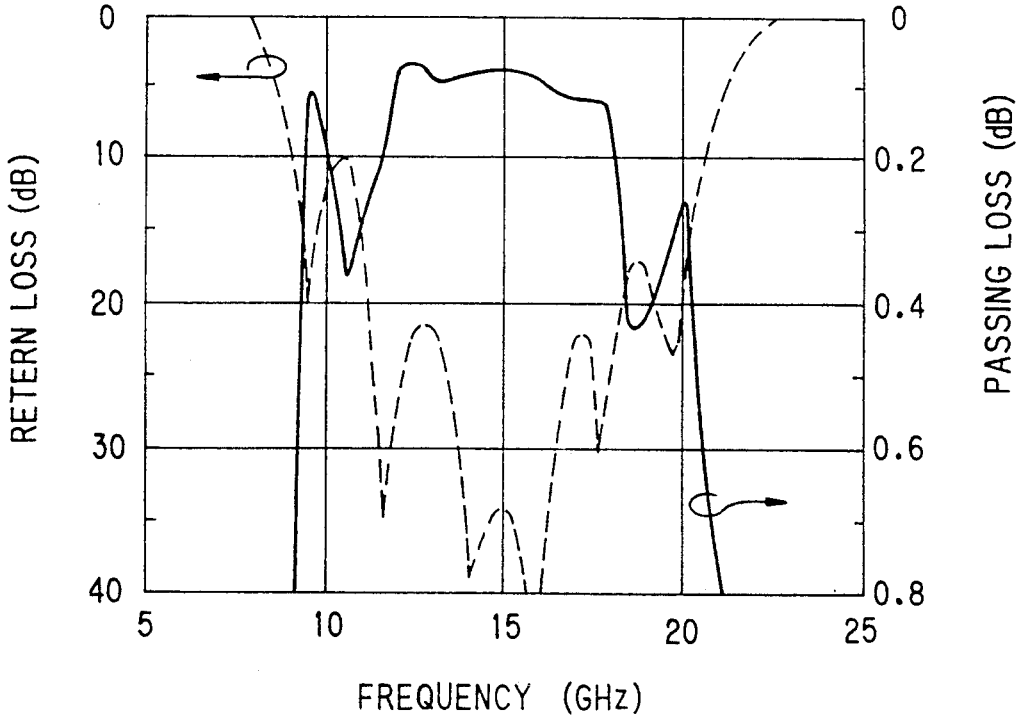
FIG. 6 PRIOR ART
FIG. 6 is a graph showing a signal-pass characteristics of the second conventional high-frequency bias supply circuit.

FIG. 6 shows a radio frequency characteristic of the second conventional high-frequency bias supply circuit 50, wherein a radio signal having a center frequency of 15 GHz is passed through the main signal line 52. In this graph, passing loss of the radio signal is shown by a solid line, and return loss is shown by a dashed line. According to the graph, it is found that the frequency characteristic of the second conventional high-frequency bias supply circuit 50 has a flat portion around 15 GHz center frequency.

According to the second conventional high-frequency bias supply circuit 50, the quarter-wave lines 56*a*, 56*b*, 56*c*, 56*d* and 56*e* are used therein, so that a bias current supplied to the main signal line 52 is increased in proportional to the number thereof.

Therefore, a frequency bandwidth is expanded as understood from FIG. 6. However, there is a disadvantage in that a ripple occurs in the frequency characteristic as shown in FIG. 6, so that the frequency bandwidth is not so wide as expected.

Figure 7:
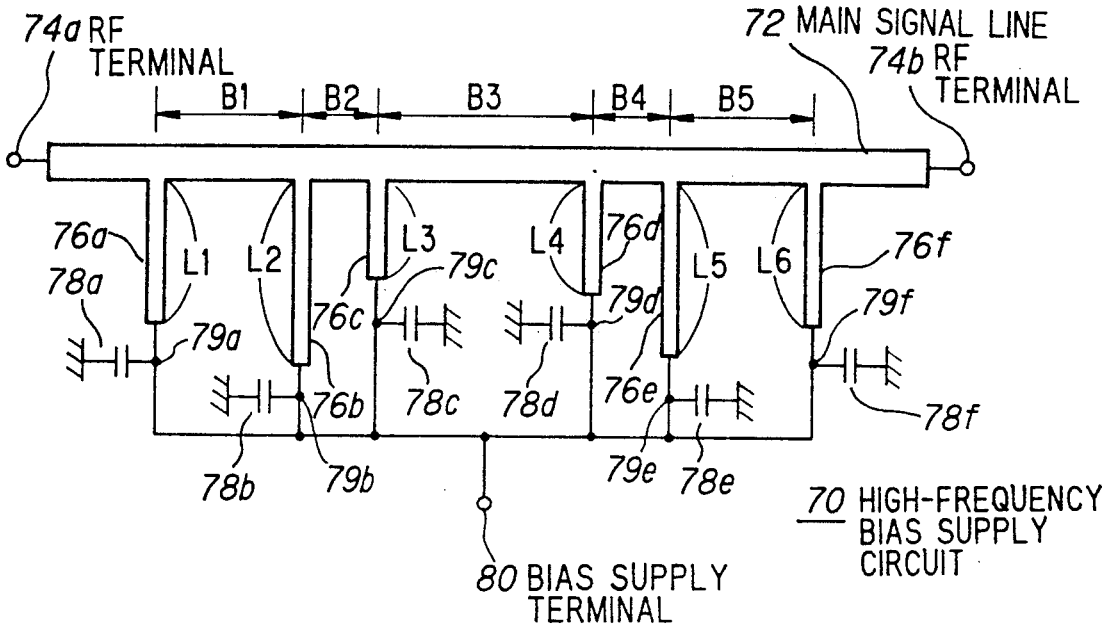
FIG. 7 is a circuit diagram showing a high-frequency bias supply circuit of a first preferred embodiment according to the invention.

FIG. 7 shows a high-frequency bias supply circuit 70 of a first preferred embodiment according to the invention, which includes a main signal line 72 connected between RF (radio frequency) terminals 74*a* and 74*b*, six of bias supply lines 76*a*, 76*b*, 76*c*, 76*d*, 76*e* and 76*f* each connected between one side of the main signal line 72 and a common bias supply terminal 80, and six of capacitors 78*a*, 78*b*, 78*c*, 78*d*, 78*e* and 78*f* connected between ground and connection points 79*a*, 79*b*, 79*c*, 79*d*, 79*e* and 79*f*, respectively. The bias supply lines 76*a*, 76*b*, 76*c*, 76*d*, 76*e* and 76*f* are distributed parameter lines which have lengths of L1, L2, L3, L4, L5 and L6, and are positioned having distances of B1, B2, B3, B4 and B5.

The lengths of L1, L2, L3, L4, L5 and L6, and the distances of B1, B2, B3, B4 and B5 are determined by following expressions, respectively, on condition that the center frequency of a radio signal passing through the main signal line 72 is 15 GHz. In these expressions, "Lc" is a quarter wavelength of the center frequency "fc" of the radio frequency signal passing through the main signal line 72.

| | |
|---|---|
| L1 = 1.1 Lc | B1 = 0.84 Lc |
| L2 = 1.3 Lc | B2 = 0.44 Lc |
| L3 = 0.7 Lc | B3 = 1.40 Lc |
| L4 = 0.8 Lc | B4 = 0.52 Lc |
| L5 = 1.2 Lc | B5 = 1.00 Lc |
| L6 = 1.0 Lc | |

Figure 8:
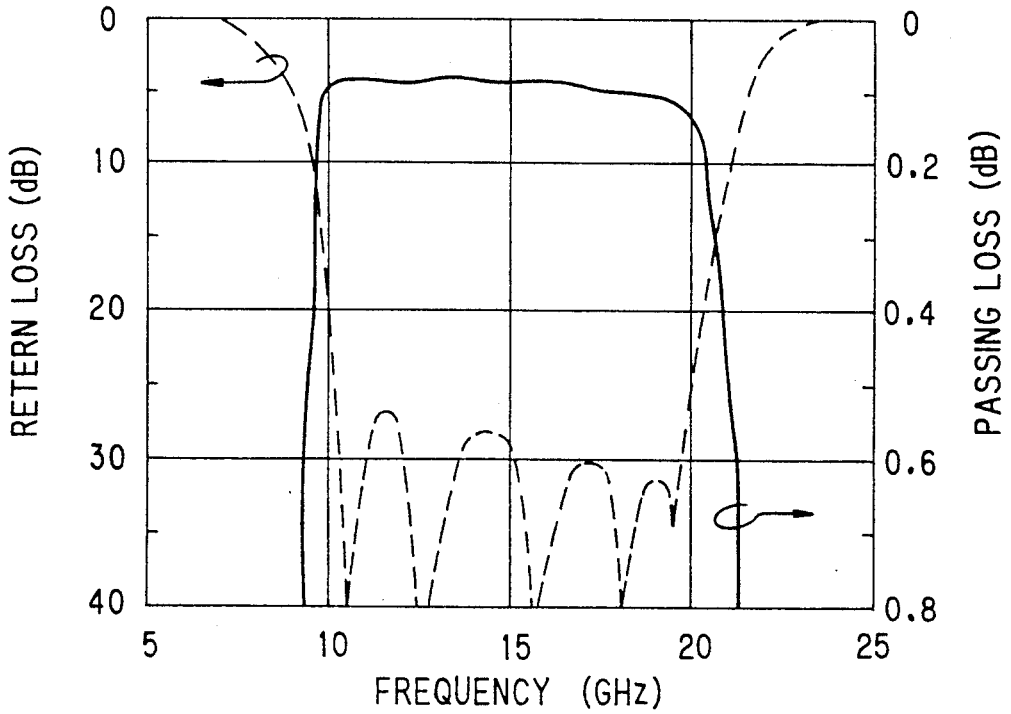
FIG. 8 is a graph showing a signal-pass characteristics of the first preferred embodiment.

FIG. 8 shows a radio frequency characteristic of the first preferred embodiment. In this graph, passing loss of the radio signal is shown by a solid line, and return loss thereof is shown by a dashed line. According to the graph, it is found that the frequency characteristic having a flat portion around 10 to 20 GHz is obtained.

According to the fist preferred embodiment, no ripple occurs in the frequency characteristic as shown in FIG. 8, so that a frequency bandwidth is expanded sufficiently.

Figure 9:
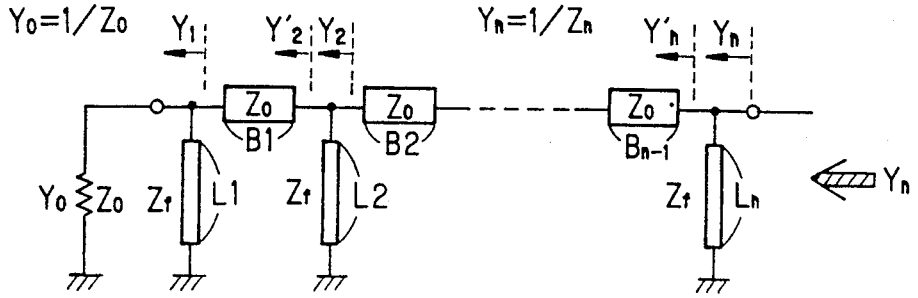
FIG. 9 is an equivalent circuit of a high-frequency bias supply circuit according to the invention.

FIG. 9 shows an equivalent circuit of a high-frequency bias supply circuit having bias supply lines of the number of "n". In this figure, an impedance of a main signal line is "$Z_o$", and an impedance of each of bias supply lines is "$Z_f$".

In the high-frequency bias supply circuit, lengths L1 to Ln of the bias supply lines, and distances B1 to $B_{n-1}$ between the two adjacent bias supply lines are determined to meet the following dimensions (1) and (2).

$$L1 \text{ to } Ln = Lc \pm 50\% \quad (1)$$

$$B1 \text{ to } B_{n-1} = Lc \pm 50\% \quad (2)$$

In FIG. 9, the following expressions are met, where $Y_n$ is equal to $1/Z_n$ ($Y_n = 1/Z_n$)

$$Y_1 = Y_0 - jY_f \cot\beta L1$$
$$Y_2 = Y_0 (Y_1 + jY_0 \tan\beta B1)/(Y_0 + jY_f \tan\beta B1)$$
$$Y_2 = Y_2 - jY_f \cot\beta L2$$
$$Y_3 = Y_0 (Y_2 + jY_0 \tan\beta B2)/(Y_0 + jY_2 \tan\beta B2)$$
$$Y_3 = Y_3 - jY_f \cot\beta L3$$
$$\cdot$$
$$\cdot$$
$$Y_n' = Y_0 (Y_{n-1} + jY_0 \tan\beta B(n-1))/(Y_0 + jY_{n-1} \tan\beta B(n-1))$$
$$Y_n = Y_n' - jY_f \cot\beta Ln$$

where "$\beta$" is a phase constant which is expressed by "$\beta = 2\pi/\lambda g$".

In the above expressions, the length L1 to L(n−1) and the distances B1 to B(n−1) are designated to meet the below expression in a desired bandwidth.

$$Yn \approx Y_o (= 1/Z_o)$$

This means that a reactance component of each bias supply line "$Y_f \cot \beta Ln$" is mutually cancelled in a wide bandwidth.

Figure 10:
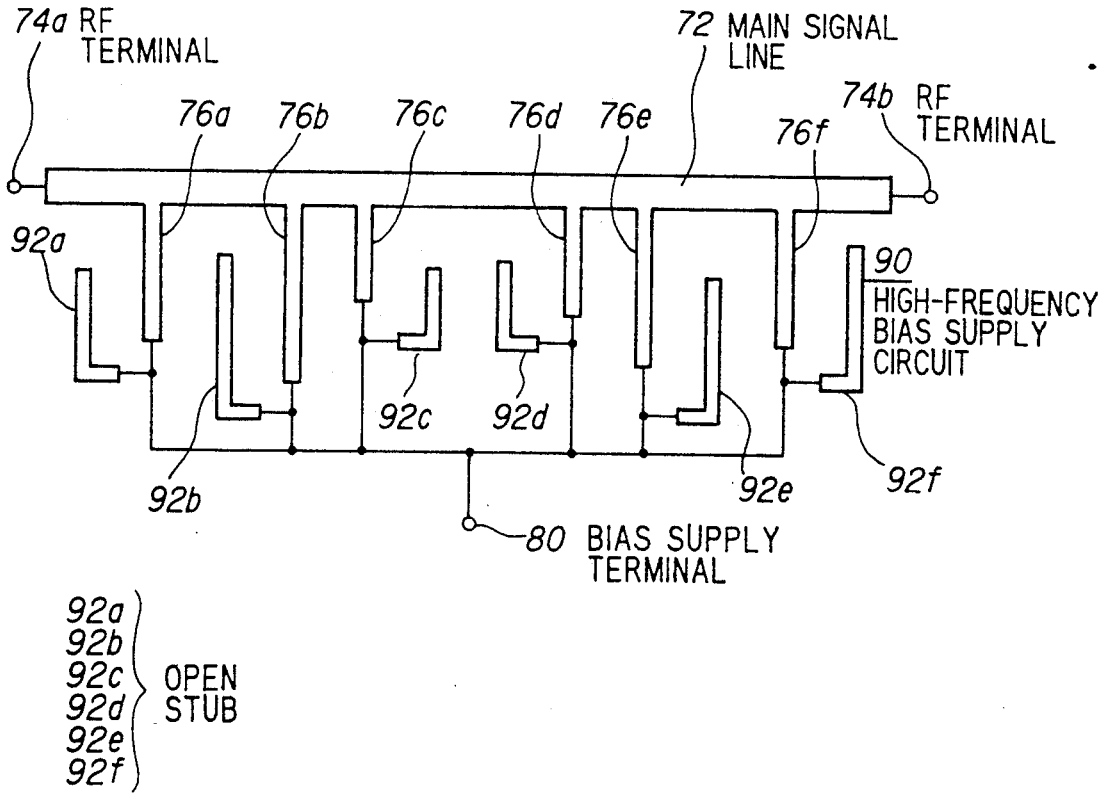
FIG. 10 is a circuit diagram showing a high-frequency bias supply circuit of a second preferred embodiment according to the invention.

FIG. 10 shows a high-frequency bias supply circuit 90 of a second preferred embodiment according to the invention. The high-frequency bias supply circuit 90 uses six open stubs 92*a*, 92*b*, 92*c*, 92*d*, 92*e* and 92*f* instead of the capacitors 78*a*, 78*b*, 78*c*, 78*d*, 78*e* and 78*f* of the first preferred embodiment. The open stubs 92*a*, 92*b*, 92*c*, 92*d*, 92*e* and 92*f* operate as same as the capacitors 78*a*, 78*b*, 78*c*, 78*d*, 78*e* and 78*f*, so that the same effect as the first preferred embodiment can be obtained by the second preferred embodiment.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. A high-frequency bias supply circuit, comprising:

a main signal line through which a radio frequency signal of a predetermined center frequency is passed; and a plurality of bias supply lines each of which is connected in parallel with others between a corresponding one of selected points along said main signal line and a common bias supply terminal to which a bias current is supplied;

wherein each of said bias supply lines has a length and a distance from an adjacent bias supply line different from those of others, said length and said distance being in a range of a $\frac{1}{8}$ to $\frac{3}{8}$ wavelength of said center frequency.

2. A high-frequency bias supply circuit, according to claim 1, further comprising:

capacitors connected to be positioned at the supply side of said bias supply lines between ground and said common bias supply terminal, respectively.

3. A high-frequency bias supply circuit, according to claim 1, further comprising:

open stubs connected to be positioned at the supply side of said bias supply lines, respectively.

4. A high-frequency bias supply circuit, comprising:

a main signal line through which a radio frequency signal is passed; and bias supply lines of "n" (n=1, 2, 3 . . . ) in number, lengths thereof being of L1 to Ln, output ends of said bias supply lines being connected to said main signal line by predetermined intervals B1 to B(n−1), and input ends thereof being connected to a common bias supply terminal;

wherein said lengths L1 to Ln and said intervals B1 to B(n−1) are set to meet following expressions in a predetermined bandwidth;

$$Y_1 = Y_0 - jY_f \cot\beta l1$$
$$Y_2' = Y_0 (Y_1 + jY_0 \tan\beta B1)/(Y_0 + jY_f \tan\beta B1)$$
$$Y_2 = Y_2' - jY_f \cot\beta L2$$
$$Y_3' = Y_0 (Y_2 + jY_0 \tan\beta B20)/(Y_0 + jY_2 \tan\beta B2)$$

-continued $$Y_3 = Y_3 - jY_f \cot\beta L3$$

.

.

.

$$Y_n' = Y_0 (Y_{n-1} + jY_0 \tan\beta B(n-1))/(Y_0 + jY_{n-1} \tan\beta B(n-1))$$
$$Y_n = Y_n' - jY_f \cot\beta Ln$$
$$Y_n = Y_0 (=1/Z_0)$$

where $Y_n = 1/Z_n$, a phase constant "$\beta$" is equal to $2\pi/\lambda(\beta = 2\pi/\lambda g)$, $Z_0$ is a characteristic impedance of said main signal line, $Y_0$ is a characteristic admittance of said main signal line, $Z_f$ is a characteristic impedance of a bias supply line, $Y_f$ is a characteristic admittance of a bias supply line, $Z_n$ is an impedance of the bias supply circuit consisting of n bias supply lines, $Y_n$ is an admittance of the bias supply circuit consisting of n bias supply lines, $Z_n'$ is an impedance of the bias supply circuit of n bias supply lines with the nth bias supply line deleted therefrom.

$Y_n'$ is an admittance of the bias supply circuit of n bias supply liens with the nth bias supply line deleted therefrom, $\lambda g$ is a wavelength.

5. A high-frequency bias supply circuit, according to claim 4, wherein:

said lengths L1 to Ln are in the range of Lc±50%, and said intervals B1 to B(n−1) are in the range of Lc±50%, where Lc is a length of a quarter wavelength of a central frequency of said ratio frequency signal.

* * * * *